US010631579B2

(12) United States Patent
Hadley

(10) Patent No.: US 10,631,579 B2
(45) Date of Patent: Apr. 28, 2020

(54) UNDERGARMENT ASSEMBLY

(71) Applicant: Lana Hadley, Coatesville, IN (US)

(72) Inventor: Lana Hadley, Coatesville, IN (US)

( * ) Notice: Subject to any disclaimer, the term of this patent is extended or adjusted under 35 U.S.C. 154(b) by 76 days.

(21) Appl. No.: 15/956,856

(22) Filed: Apr. 19, 2018

(65) Prior Publication Data

US 2019/0320730 A1 Oct. 24, 2019

(51) Int. Cl.

| | |
|---|---|
| ***A41C 3/08*** | (2006.01) |
| ***A41B 9/06*** | (2006.01) |
| ***A44B 17/00*** | (2006.01) |

(52) U.S. Cl.

CPC ..... *A41B 9/06* (2013.01); *A44B 17/0041* (2013.01); *A41B 2400/38* (2013.01); *A41B 2400/70* (2013.01); *A41C 3/08* (2013.01)

(58) Field of Classification Search

CPC ..... A41B 9/06; A44B 17/0041
USPC ..... 450/30, 1, 33
See application file for complete search history.

(56) References Cited

U.S. PATENT DOCUMENTS

| | | | | |
|---|---|---|---|---|
| 3,890,978 | A * | 6/1975 | Nobbs | A41C 3/0021 450/61 |
| 6,000,993 | A | 12/1999 | Erwin | |
| D609,880 | S | 2/2010 | Maschue | |
| 7,780,502 | B2 * | 8/2010 | Calamari | A41C 3/08 2/105 |
| 8,647,168 | B2 | 2/2014 | Anvaripour | |
| 9,113,660 | B2 | 8/2015 | Op't Hof | |
| 9,131,735 | B2 | 9/2015 | Cavosie | |
| 2010/0107302 | A1 * | 5/2010 | Ross | A41B 9/06 2/113 |
| 2011/0124267 | A1 * | 5/2011 | Op't Hof | A41B 9/06 450/33 |

* cited by examiner

*Primary Examiner* — Timothy K Trieu

(57) ABSTRACT

An undergarment assembly for inhibiting bulges resulting from an elastic undergarment includes a garment for wearing over brassiere and beneath clothing. The garment is comprised of a deformable and non-elastic material such that said garment does not constrict when said garment is worn. In this way the garment is inhibited from forming bulges on a user's torso that may be visible through the clothing. The garment includes a pair of straps and each of the straps is releasably attached to a respective pair of brassiere straps to retain the garment on the user.

4 Claims, 4 Drawing Sheets

UNDERGARMENT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to undergarment devices and more particularly pertains to a new undergarment device for inhibiting bulges resulting from an elastic undergarment.

BRIEF SUMMARY OF THE INVENTION

An embodiment of the disclosure meets the needs presented above by generally comprising a garment for wearing over brassiere and beneath clothing. The garment is comprised of a deformable and non-elastic material such that said garment does not constrict when said garment is worn. In this way the garment is inhibited from forming bulges on a user's torso that may be visible through the clothing. The garment includes a pair of straps and each of the straps is releasably attached to a respective pair of brassiere straps to retain the garment on the user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
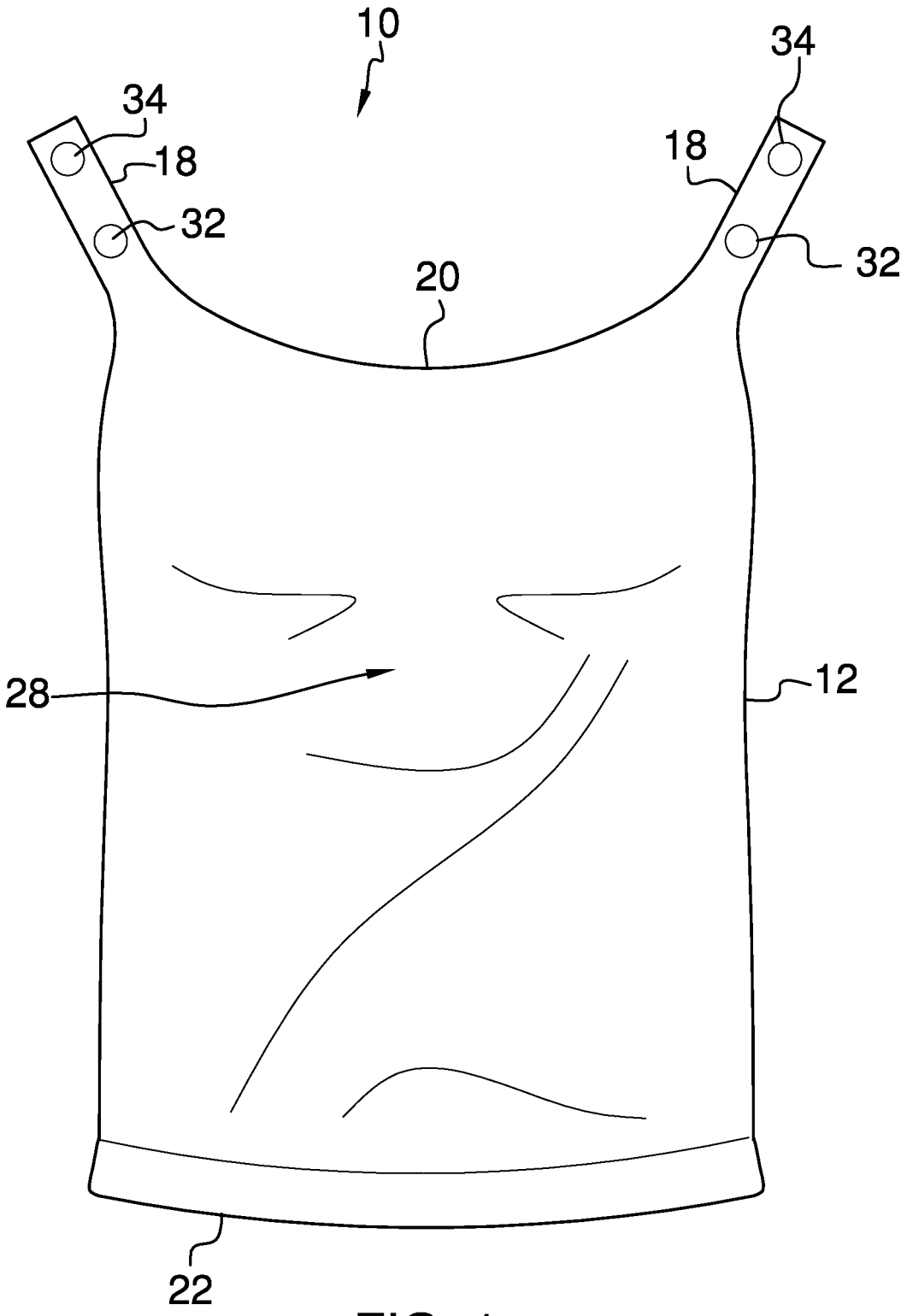
FIG. 1 is a front view of an undergarment assembly according to an embodiment of the disclosure.
Figure 2:
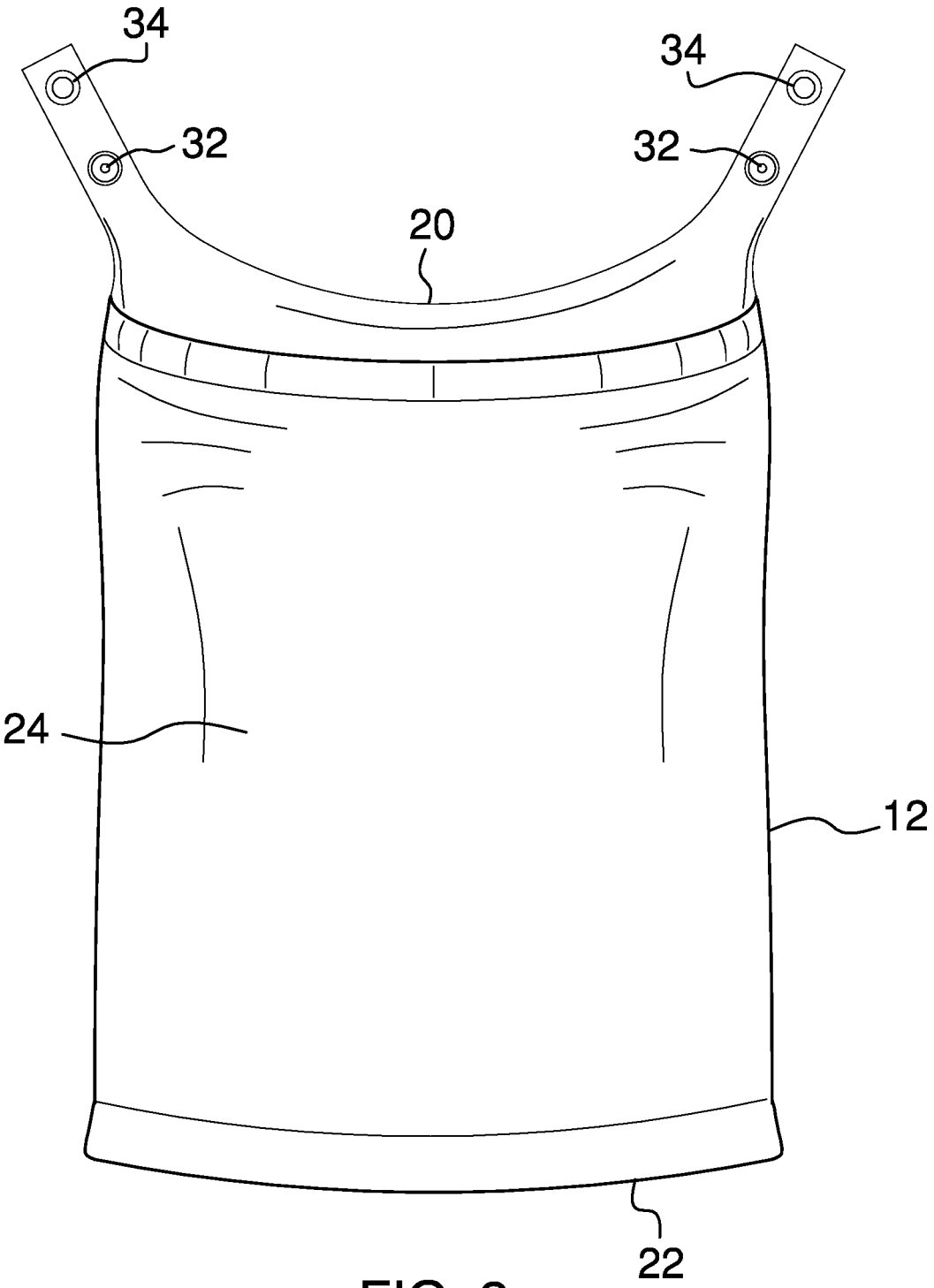
FIG. 2 is a back view of an embodiment of the disclosure.
Figure 3:
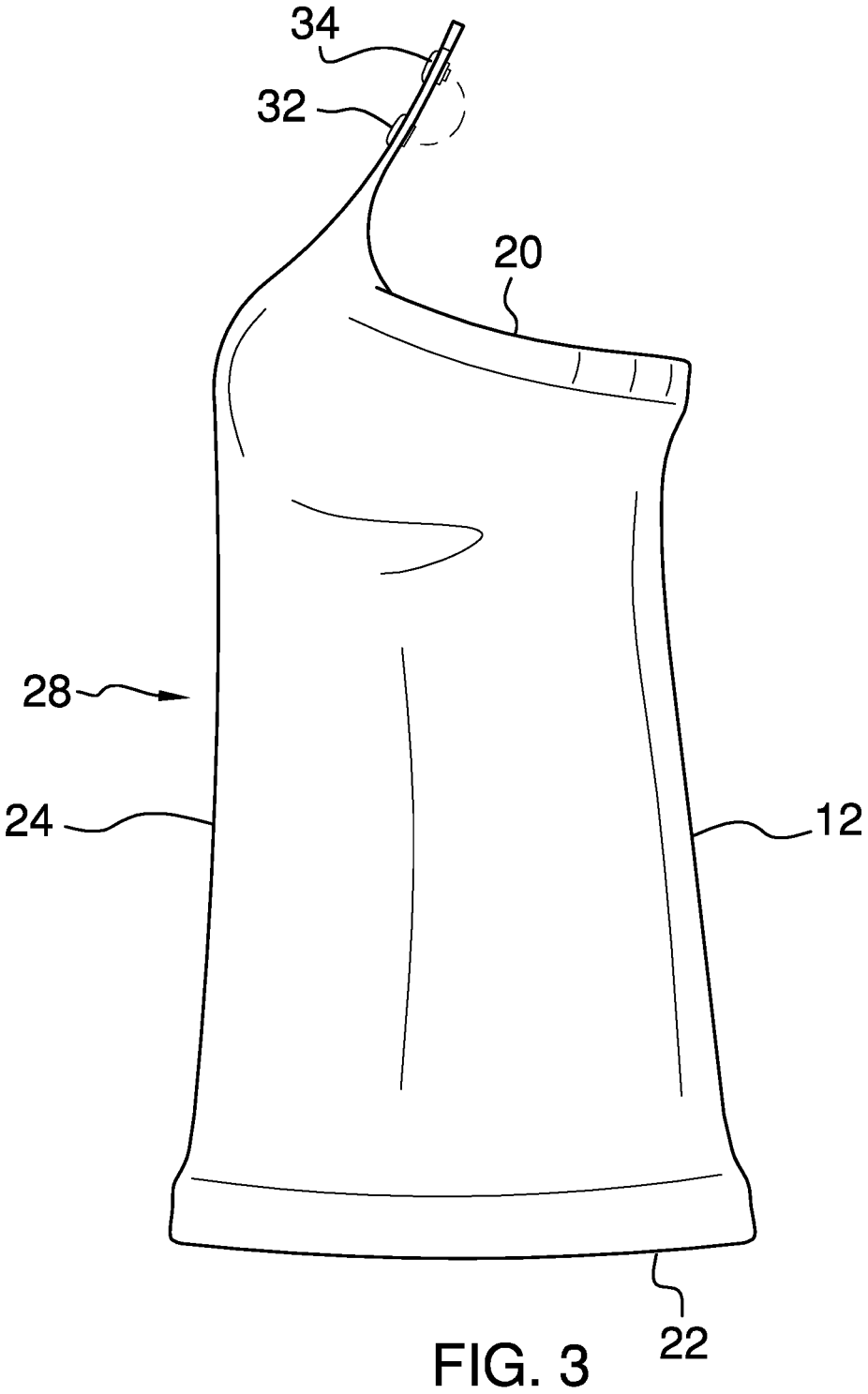
FIG. 3 is a left side view of an embodiment of the disclosure.
Figure 4:
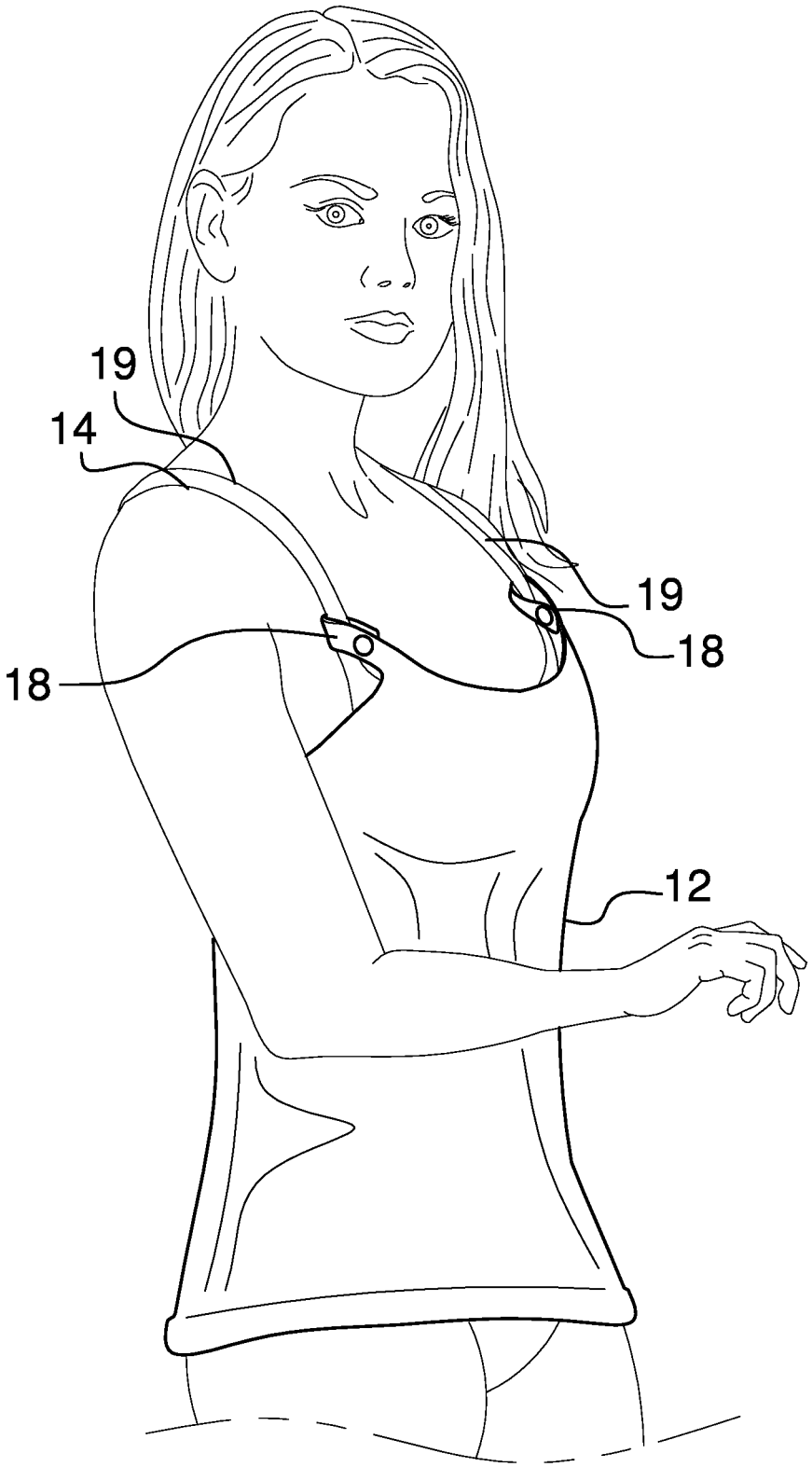
FIG. 4 is a perspective in-use view of an embodiment of the disclosure.

With reference now to the drawings, and in particular to FIGS. 1 through 4 thereof, a new undergarment device embodying the principles and concepts of an embodiment of the disclosure and generally designated by the reference numeral 10 will be described.

As best illustrated in FIGS. 1 through 4, the undergarment assembly 10 generally comprises a garment 12 for wearing over a brassiere 14 and beneath clothing. The brassiere 14 may be a bra and the clothing may be a blouse, a shirt and any other article of clothing commonly worn on a woman's torso 16. The garment 12 is comprised of a deformable and non-elastic material such that the garment does not constrict when the garment is worn. Thus, the garment 12 does not create bulges in the woman's torso that could possibly be visible through the clothing. The garment 12 includes a pair of straps 18 and each of the straps 18 is releasably attached to a respective pair of brassiere straps 19 to retain the garment 12 on a user.

The garment 12 has a top end 20, a bottom end 22 and an outer wall 24 extending therebetween. Each of the top end 20 and the bottom end 22 is open and the outer wall 24 is continuous such that the garment 12 may be worn around the woman's torso 16. Moreover, the outer wall may flare outwardly between the top end 20 and the bottom end 22 thereby facilitating the garment to freely flow over the woman's hips 25. Each of the straps 18 extends upwardly from the top end 20 and has a distal end 26 with respect to the top end 20. Moreover, the straps 18 are spaced apart from each other and are aligned with a front side 28 of the garment 12.

A pair of first fasteners 32 is provided and each of the first fasteners 32 is coupled to a respective one of the straps 18. A pair of second fasteners 34 is provided and each of the second fasteners 34 is coupled to a respective one of the straps 18. Each of the second fasteners 34 is spaced from the first fastener 32 on the respective strap 18. Additionally, each of the second fasteners 34 releasably engages the first fastener 32 on the respective strap 18 to retain each of the straps 18 in a closed loop around the respective brassiere strap 19. Each of the first 32 and second 34 fasteners may comprise snaps or any other type of releasable fastener.

In use, the garment 12 is worn around the user's torso 16 over the brassiere 14. Each of the straps 18 is looped around the respective brassiere strap 19 and the first fastener 32 on each strap 18 is coupled to the second fastener 34 on the respective strap 18. Thus, each of the straps 18 is releasably coupled to the brassiere 14 to retain the garment 12 on the user's torso 16. The non-elastic property of the garment combined with the outward flare of the outer wall of the garment facilitates the garment to flow freely on the woman. In this way the garment does not compress against the woman's torso and create bulges that could be visible through the clothing when the clothing is worn over the garment 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An undergarment assembly being configured to be worn between a brassiere and clothing for concealing bulges from the brassiere, said assembly comprising:

a garment for wearing over a brassiere and beneath clothing, said garment being comprised of a deformable and non-elastic material such that said garment is configured to reduce constriction of a user's torso when said garment is worn wherein said garment is configured to inhibit forming bulges on the user's torso;

a pair of straps, each of said straps being coupled to said garment, each of said straps being releasably attached to a respective pair of brassiere straps to retain said garment on a user, each of said straps having a proximal end coupled to said garment wherein each strap extends outwardly away from said garment;

a pair of first fasteners, each of said first fasteners being coupled to a respective one of said straps and positioned spaced from said proximal end wherein each of said first fasteners is spaced from said garment; and a pair of second fasteners, each of said second fasteners being coupled to a respective one of said straps, each of said second fasteners being positioned proximate a distal end of said respective one of said straps relative to said garment, each of said second fasteners being spaced from said first fastener on said respective strap, each of said second fasteners releasably engaging said first fastener on said respective strap to retain each of said straps in a closed loop around the respective brassiere strap.

2. The assembly according to claim 1, wherein said garment has a top end, a bottom end and an outer wall extending therebetween, said outer wall being continuous such that said garment has a cylindrical shape wherein said garment is configured to be worn around the user's torso.

3. The assembly according to claim 2, wherein each of said straps extends upwardly from said top end and having a distal end with respect to said top end, said straps being spaced apart from each other and being aligned with a front side of said garment.

4. An undergarment assembly being configured to be worn between a brassiere and clothing for concealing bulges from the brassiere, said assembly comprising:

a garment for wearing over a brassiere and beneath clothing, said garment being comprised of a deformable and non-elastic material such that said garment is configured to reduce constriction of a user's torso when said garment is worn wherein said garment is configured to inhibit forming bulges on the user's torso;

a pair of straps, each of said straps being coupled to said garment, each of said straps being releasably attached to a respective pair of brassiere straps to retain said garment on a user, said garment having a top end, a bottom end and an outer wall extending therebetween, said outer wall being continuous wherein said garment is configured to be worn around the user's torso, each of said straps extending upwardly from said top end and having a distal end with respect to said top end, said straps being spaced apart from each other and being aligned with a front side of said garment;

a pair of first fasteners, each of said first fasteners being coupled to a respective one of said straps; and a pair of second fasteners, each of said second fasteners being coupled to a respective one of said straps, each of said second fasteners being spaced from said first fastener on said respective strap, each of said second fasteners releasably engaging said first fastener on said respective strap to retain each of said straps in a closed loop around the respective brassiere strap.

* * * * *